United States Patent [19]

Hiersig et al.

[11] 4,311,472

[45] Jan. 19, 1982

[54] MARINE PROPULSION SYSTEM FOR TWO PROPELLERS

[75] Inventors: Heinz M. Hiersig, Duesseldorf; Hans Steinberg, Witten, both of Fed. Rep. of Germany

[73] Assignee: Mannesmann Aktiengesellschaft, Duesseldorf, Fed. Rep. of Germany

[21] Appl. No.: 90,971

[22] Filed: Nov. 5, 1979

[30] Foreign Application Priority Data

Nov. 15, 1978 [DE] Fed. Rep. of Germany ..... 2850045

[51] Int. Cl.[3] ..... F16H 37/06

[52] U.S. Cl. ..... 440/75; 440/86; 74/665 L; 114/269

[58] Field of Search ..... 440/3, 4, 75, 79, 83, 440/86; 114/269; 74/665 L, 665 N, 665 P

[56] References Cited

U.S. PATENT DOCUMENTS

| | | | |
|---|---|---|---|
| 3,487,721 | 1/1970 | Burkhardt et al. | 74/665 N |
| 3,881,444 | 5/1975 | Sigg | 440/75 |
| 4,188,837 | 2/1980 | Bendall | 440/75 X |

*Primary Examiner*—Joseph J. Rolla

*Attorney, Agent, or Firm*—Smyth, Pavitt, Siegemund & Martella

[57] ABSTRACT

Two separately operable turbines are regularly connected individually to two propellers, via reducing gears in each instance, whereby an intermediate shaft is included in each such power train. These intermediate shafts are interconnected via an interconnecting transmission gear with clutches at either end, so that this transmission is completely removed when both turbines drive the propellers while either turbine can drive both propellers when the clutches are operated. Details of the mounting and of the gears and their configuration are disclosed.

7 Claims, 4 Drawing Figures

1
2
15
14
4
3
17
16
5
6
7
9
8
11
10
13
12

MARINE PROPULSION SYSTEM FOR TWO PROPELLERS

BACKGROUND OF THE INVENTION

The present invention relates to marine drive systems; and more particularly, the invention relates to the drive and gearing of two propellers for a ship.

The U.S. Pat. No. 3,881,444 (see also German printed Patent Application 21,34,972) describes a gear transmission for a pair of marine propellers in which each propeller has its own shaft, and an intermediate shaft is geared to the respective propeller shaft. Moreover, a separate turbine with a clutch is provided for each gear; but interconnecting gearing couples the two intermediate shafts to each other to obtain synchronization. The system is, moreover, constructed in such a way that one turbine can, if necessary, drive both propellers. This mode of operation can be used, e.g., for slow-speed cruising, while high-speed propulsion requires running of both turbines.

German Pat. No. 21,87,237 describes also a two-propeller, two-turbine system and a connection which also runs always when both of the two turbines run, so that here, too, the connecting transmission consumes power.

DESCRIPTION OF THE INVENTION

It is an object of the present invention to provide a new and improved transmission system by means of which two propellers of a ship are connected to two turbines, whereby particularly the direct connection between a turbine and a propeller shaft is not to be impeded by transmission means from one drive to the other, though the two propeller shafts should be connectable to one another.

It should be observed that, preferably, gas turbines are to be used which are usually directly speed-controlled without clutches. Moreover, in the case of adjustable propeller optimizing, its adjustment position is of little consequence In the case of low speed, the propeller may run at a speed which is optimized as far as turbine operation is concerned, while upon adding the second gas turbine, it is merely necessary to increase the pitch of the propeller. These several conditions and particulars for gas turbine operation and propeller drives should be taken into consideration.

In accordance with the preferred embodiment of the present invention, a two-engine (turbine, e.g., gas turbine) ship drive system with reducing gears and two propellers is to be improved upon as follows. The propellers are connected individually to the turbines via reduction gearing and including, in each instance, an intermediate shaft. These intermediate shafts are interconnected by a connecting transmission gear with a clutch on either end. These clutches disconnect the connecting gear from the system when the propellers are separately driven by the turbines; but upon operating the clutches, either one of the turbines can drive both propellers. The reducing gears or a portion thereof which includes the intermediate shafts as well as the interconnecting gear transmission could be mounted in a common housing; however, one should separately house the reducing gear or a portion thereof for the straight-through connection from a turbine to its normally associated propeller while the interconnect transmission gear and the clutches are mounted in another casing; the connection to the reducing gear stages and the interconnect transmission will run through articulated shafts. Also, the clutches may each be connected to a pair of concentric shafts of which the hollow one carries pinion means which already pertain to the interconnect transmission, while the inner one leads to, or pertains to, the respective intermediate shaft of a turbine-to-propeller drive train.

DESCRIPTION OF THE DRAWINGS

While the specification concludes with claims, particularly pointing out and distinctly claiming the subject matter which is regarded as the invention, it is believed that the invention, the objects and features of the invention, and further objects, features, and advantages thereof will be better understood from the following description taken in connection with the accompanying drawings in which

Figure 1:
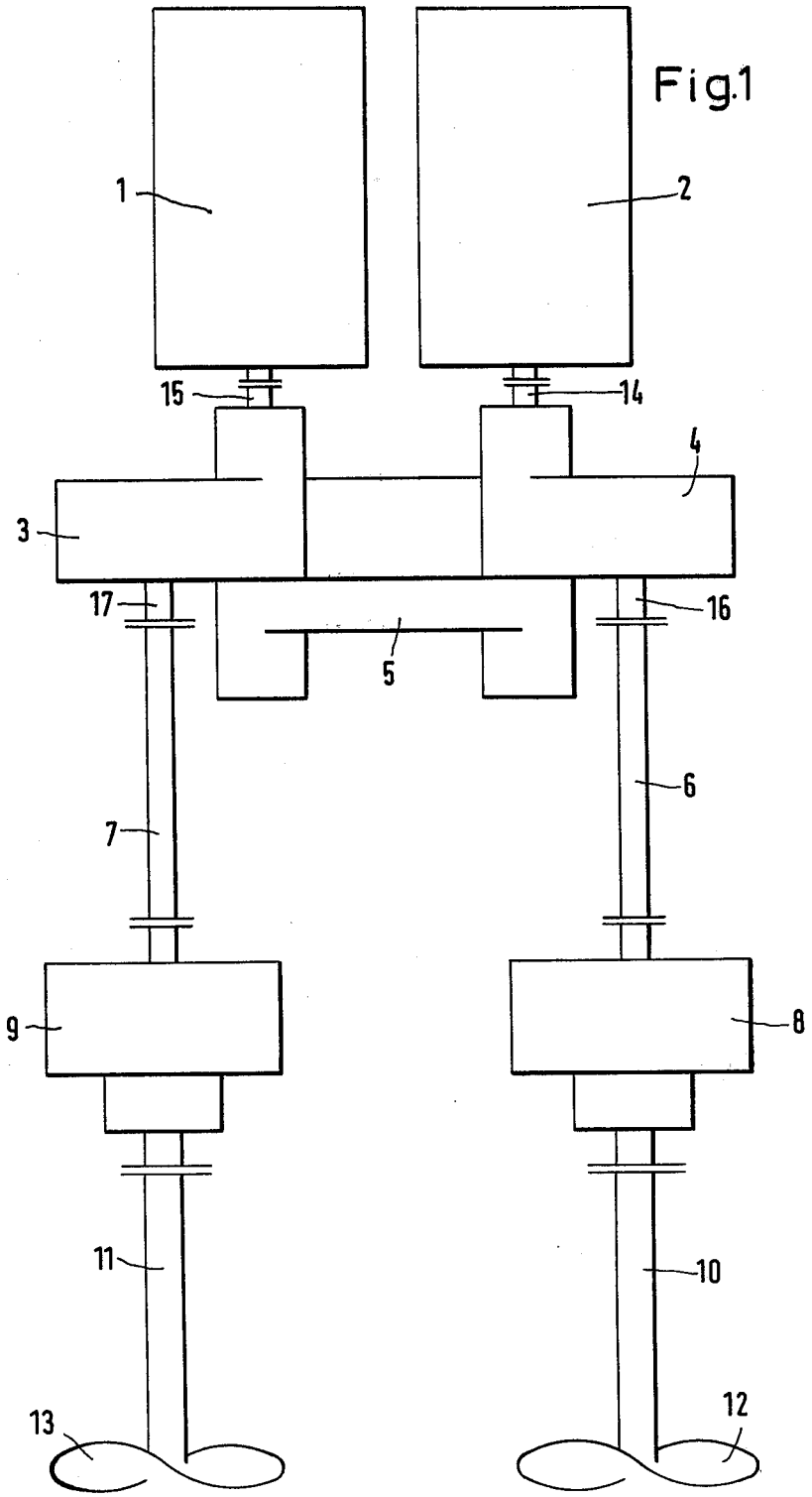
FIG. 1 is a schematic illustration of a ship's drive system for two propellers.

Proceeding now to the detailed description of the drawings, the overview of a system shown in FIG. 1 reveals two gas turbines 1 and 2, respectively; two reducing gear stages 3 and 4, respectively drivingly connected to the turbines 1 and 2 by means of shafts 15 and 14; and a connecting gear stage 5, linking the two reducing gears or units 3 and 4. The stages or units 3 and 4, moreover, are drivingly and by means of output shafts 17 and 16 connected to intermediate shafts 7 and 6, for driving second reducing gears 9 and 8, respectively. Gears 8 and 9, in turn, drive the propeller shafts 10 and 11 with propellers 12 and 13.

Figure 2:
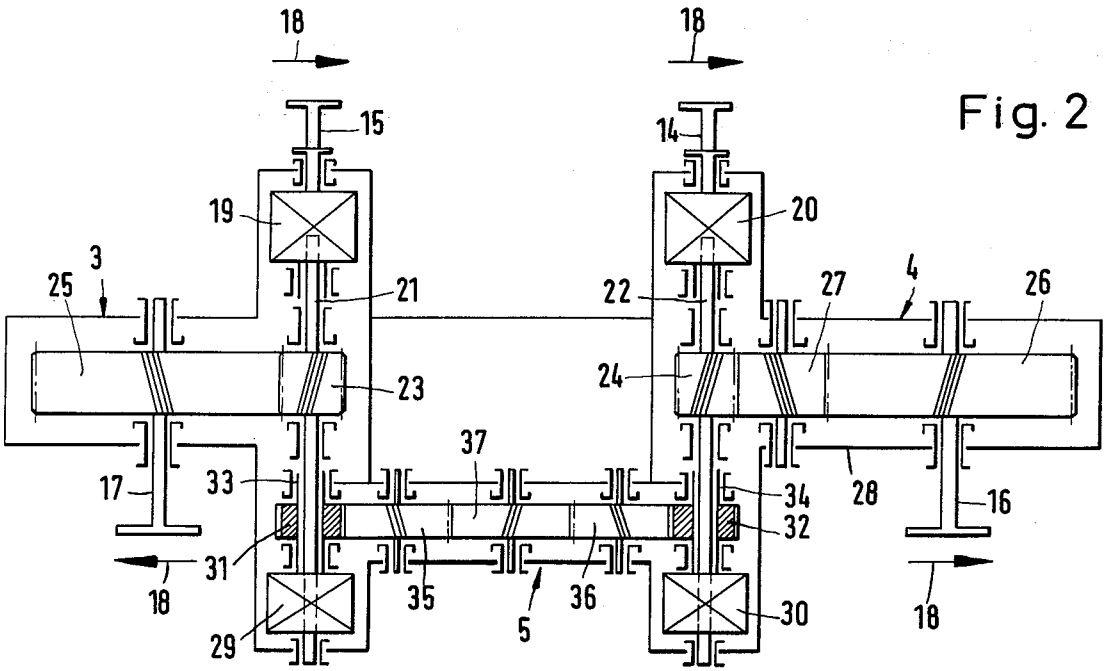
FIG. 2 is a schematic view of a detail of the system shown in FIG. 1 and relates particularly to features in accordance with the preferred embodiment of the invention.

The invention is particularly concerned with the gear stages or units 3 and 4 as well as the interconnect stage 5, and details here are depicted with greater particularity in FIGS. 2, et seq. The remaining parts and portions of the system shown in FIG. 1 are conventional.

Turning, therefore, to FIG. 2, the two input shafts 15 and 14 of stages 3 and 4 (already shown in FIG. 1) are shown here to be connected to overriding clutches 19 and 20 which are, therefore, driven directly by the gas turbines 1 and 2. During a normal (high-speed), two-turbine operation, power is transmitted through both of these clutches.

Override clutch 19 has a drive shaft 21 which carries a pinion 23, meshing with a larger gear 25; gears 23 and 25 constitute the reducing stage proper of unit 3. Gear 25 drives shaft 17 (see FIG. 1). The various arrows 18 denote the respective direction and sense of rotation of the components next to them.

The input shaft 14, driven by turbine 2, is connected by means of the override clutch 20 to a shaft 22 which carries a pinion 24 for meshing a reversing gear 27 which, in turn, drives a gear 26. Gear 26 sits on and drives output shaft 16 (see also FIG. 1). Reversing gear 27 is needed if both turbines 1 and 2 run in the same direction (see arrows 18 on top of FIG. 2), but the shafts 16 and 17 are to run in opposite directions.

Shaft 21 is additionally connected to one side of a controlled clutch 29 by means of which shaft 21 can be connected to a hollow shaft 33, journalled on or in relation to shaft 21 and carrying a pinion 31. Analogously, a clutch 30 permits driving connection of shaft 22 to a hollow shaft 34 driving a pinion 32. Clutches 29 and 30 are operated independantly.

Pinions 31 and 32 can be regarded as gears for connection to (or already pertaining to) the connection gear 5. The latter gear includes a gear train 35, 37, and 36, of which the gears 35 and 36 respectively mesh with pinions 31 and 32, and gear 37 interconnects the gears 35 and 36. These elements thus constitute an interconnect transmission gear by means of which the intermediate shafts 21 and 22 can be interconnected, provided the clutches are operated. It can readily be seen that by operation of the clutches 29 and 30, either turbine can drive both propellers, whereby the respective other output of gears 3 and 4 is decoupled by operation of one or the other override clutch. Reference numeral 28 denotes a common case for the gears and units 3, 4, and 5, in which the several shafts are journalled in suitable bearings.

Figure 3:
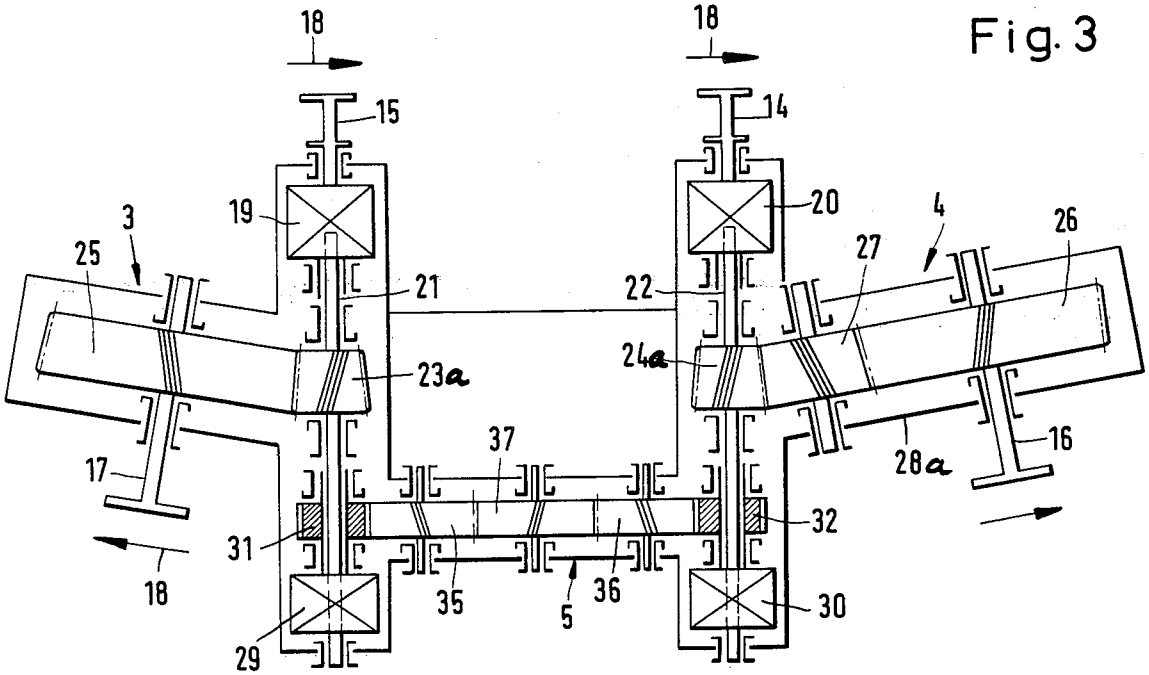
FIG. 3 is a view similar to FIG. 2 but showing a modified gear system.

FIG. 3 includes functionally all of the components of FIG. 2, but differs therefrom in that pinions 23 and 24 are replaced by bevel pinions 23*a* and 24*a*, so that the shafts 16 and 17 do not extend in parallel. This is needed in some drives. Of course, housing 28*a* is modified accordingly.

Figure 4:
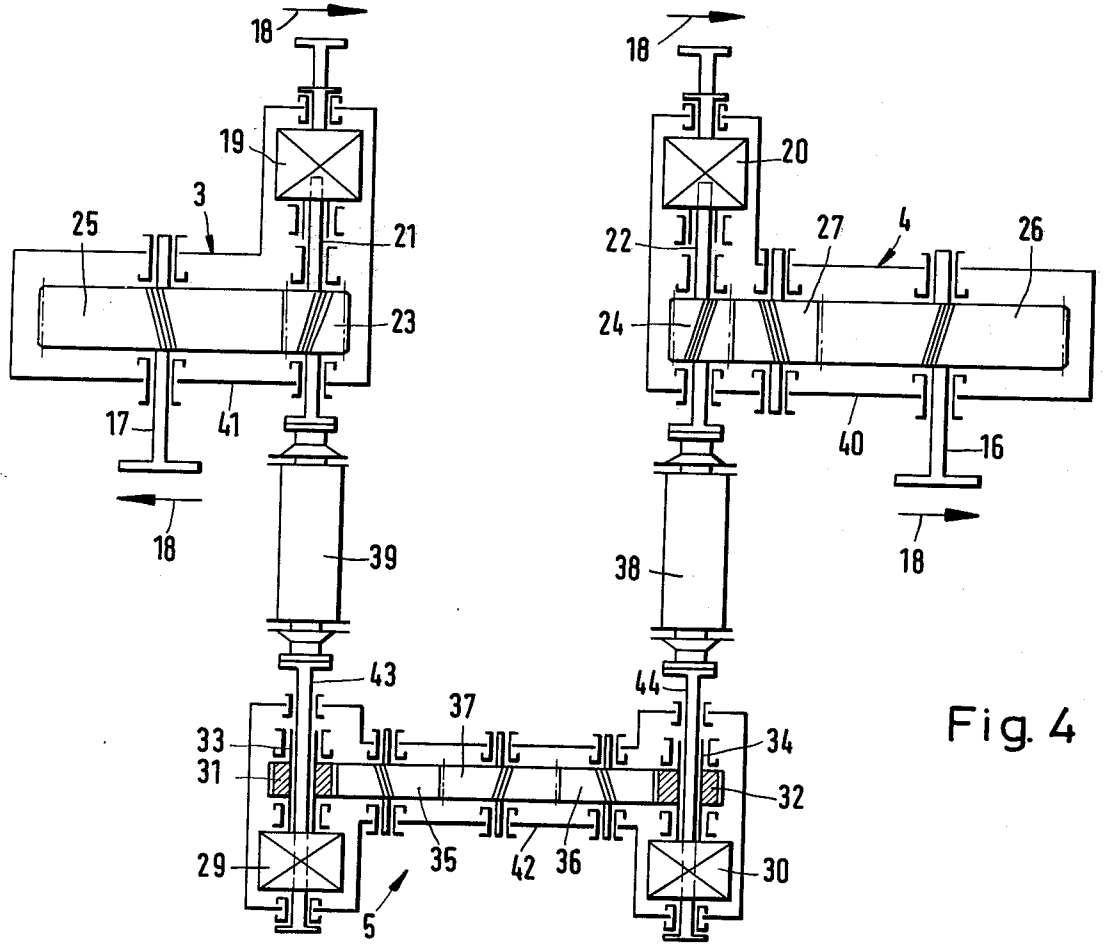
FIG. 4 is an improvement of the detail shown in FIG. 2 and describes the best mode of practicing the invention.

FIG. 4 includes, functionally, all of the components of FIG. 2, but differs therefrom as follows: Gears 3, 4, and 5 are housed in separate casings 41, 40, and 42. The several gears and shafts pertaining to the different units and stages, etc., 3, 4, and 5 are thus separately journalled in their respective cases by means of suitable bearings. Moreover, shafts 21 and 22 are shorter and connect to cardan or univeral joints like shafts 38 and 39 which, in turn, are connected to input shafts 43, and 44, respectively, of the two clutches 29 and 30. The coupling shafts 38 and 39 are hollow to reduce their weight. This articulate connection permits the several units to undergo displacements to some extent if the ship's body is torsionally loaded and stressed, subjected to bending, etc.

The several systems operate fundamentally similar; their operation will be described next. For slow cruising, one of the two turbines, 1 or 2, runs while the respective other one is off. Assume that only turbine 2 is running, override clutch 19 disconnects the running gear system from turbine 1. Turbine 2 drives shaft 22 and shaft 16 via gears 24, 27, and 26. Additionally, turbine 2 drives shaft 21 via closed clutches 29 and 30 and the connecting gear 5. Shaft 22 drives the other output shaft 17 via gears 23 and 25. Thus, both propellers are driven, whereby the power of the one turbine is distributed to both of them.

It can readily be seen that if turbine 1 is running and turbine 2 is off, all gears drive, or are driven, in the same sense, except that override clutch 20 disconnects the drive train from turbine 2. The interconnect transmission gear 5 can transmit power in either direction.

For high-speed propulsion, both turbines, 1 and 2, run and drive shafts 15 and 21, and 14 and 22. Clutches 29 and 30 are released so that the interconnect transmission gear 5 does not participate in the drive and propulsion. Each turbine just drives one gear output shaft; turbine 1 drives shaft 17 and turbine 2 drives shaft 16. As a consequence, high-speed or fast cruising is attained under exclusion of the connecting gear 5; and only those gears necessary for speed reduction and reversal participate in the operation. One thus minimizes transmission losses.

The invention is not limited to the embodiments described above, but all changes and modifications thereof not constituting departures from the spirit and scope of the invention are intended to be included.

We claim:

1. A drive and propulsion system for ships, including first and second drive engines, first and second propeller shaft means for connection to first and second propellers respectively, and a gear and transmission system, comprising:

a first and second reducing gear, respectively for connection to the first and second engines, said reducing gears each including an intermediate shaft means connected to the respective engine for being driven by the respective engine, each reducing gear further including pinion means on the intermediate shaft means, the pinion means pertaining to a reducing stage for connecting the intermediate shaft means to an output shaft, the output shafts of the first and second reducing gear being respectively connected to the first and second propeller shaft means for causing the propeller shafts to rotate in opposite directions;

override clutch means for respectively connecting the first and second engines to the intermediate shaft means so that each intermediate shaft means can be drivingly separated from the respective engine;

first and second independently operable clutch means respectively connected to the intermediate shaft means, the first and second clutch means further connected to first and second gears, the respective clutch means when operated connecting the respective latter gears to the respective intermediate shaft means; and gear means for bidirectionally interconnecting the first and second gears so that for the operated first and second clutch means, each intermediate shaft means can drive the respective other one, and the two propeller shafts rotating in opposite directions while, for the released clutches, the gears and gear means are disconnected from either of the intermediate shaft means.

2. A transmission system as in claim 1, wherein the first and second gears, as respectively connected to the first and second clutch means, are so connected by means of first and second hollow shafts receiving the respective intermediate shaft means, the first and second hollow shafts being respectively disposed between the first and second clutch means on one hand and any gearing pertaining to the reducing stages of the first and second reducing gear on the other hand.

3. A transmission system as in claim 1, wherein each of the clutch means includes an input shaft and universal joint-type connection means for respectively interconnecting the input shaft means and the intermediate shaft means.

4. A drive and propulsion system for ships, including first and second drive engines, first and second propeller shaft means for connection to first and second propellers respectively, and a gear and transmission system, comprising:

a first reducing gear unit including an intermediate shaft with a pinion and connected to the first drive engine, the first drive engine being a turbine, a gear means meshing the pinion and an output shaft connected to the first shaft means for driving the first propeller;

a second reducing gear unit, including an intermediate shaft with a pinion and connected to the second engine, the second drive engine also being a turbine, a gear means meshing the latter pinion and an output shaft connected to the second shaft means for driving the second propeller;

a first and a second clutch respectively drivingly connected to the intermediate shafts of the first and second units; and connecting gear means interconnecting the two clutches so that the intermediate shafts are drivingly interconnected when the clutches are operated, and disconnected when either one of the clutches is released.

5. A transmission system as in claim 4, wherein said first unit, said second unit, and said connecting gear means including the clutches are journalled in separate housings, there being articulated drive means interposed between the intermediate shafts and the respective clutches.

6. A transmission system as in claim 4, each said clutch means having an input shaft for connection to the respective unit, and a hollow shaft for receiving the particular shaft and connecting it thereto when the respective clutch means is operated, the hollow shafts carrying gears pertaining to the connecting gear means.

7. A transmission system as in claim 4, wherein the intermediate shafts are connected to the respective turbines by means of override clutches.

* * * * *